United States Patent [19]

Forrester et al.

[11] 4,018,175

[45] Apr. 19, 1977

[54] THREAD-TENSIONING MECHANISM FOR THE STOP MOTION MEANS OF A MULTI-NEEDLE SEWING MACHINE

[75] Inventors: Harold C. Forrester; Harold E. Tatum, both of Louisville, Ky.

[73] Assignee: Louisville Bedding Company, Louisville, Ky.

[22] Filed: Nov. 17, 1975

[21] Appl. No.: 632,384

[52] U.S. Cl. ..... 112/254; 242/151

[51] Int. Cl.[2] ..... D05B 47/02

[58] Field of Search ..... 112/254, 59, 97, 243, 112/117, 163; 242/151, 147 R; 226/195; 57/58.86

[56] References Cited

UNITED STATES PATENTS

| | | | |
|---|---|---|---|
| 1,502,048 | 7/1924 | Merritt | 112/254 |
| 2,570,617 | 10/1951 | Wentz | 242/151 |
| 3,009,433 | 11/1961 | Kuhn | 112/254 X |
| 3,698,335 | 10/1972 | Forrester | 112/243 |

FOREIGN PATENTS OR APPLICATIONS

| | | | |
|---|---|---|---|
| 22,694 | 10/1906 | United Kingdom | 242/151 |

*Primary Examiner*—Werner H. Schroeder
*Assistant Examiner*—Peter Nerbun
*Attorney, Agent, or Firm*—Arthur F. Robert

[57] ABSTRACT

An improved thread-tensioning mechanism for the stop motion means of a multi-needle machine of a well known type wherein each needle thread, in extending from its supply spool to its needle, normally travels through a thread-tensioning section at a speed and tension which varies in proportion to its rate of variable usage within a given operating or usage range. Its tension variations are sensed by a sag sensor that shuts down the machine when the tension falls below said given range. In our improved thread-tensioning mechanism, a group of independently rotatable idler wheels is provided, one for each needle thread of a corresponding group of individual threads. The periphery of each idler wheel gravitationally engages and presses its needle thread against the periphery of a rotating shaft common to all wheels. Through this engagement, each wheel is rotated by and at the varying speed of its thread. The common shaft is driven at a constant peripheral speed somewhat below the slowest lineal speed of a given operative range over which the thread and wheel speeds vary. In other words, the slowest thread and wheel speed encountered during normal operation should be slightly above the constant speed of the common shaft. So long as the lineal speed of each given thread is higher than the peripheral speed of the common shaft, the slippage therebetween causes the common shaft to operate as a frictional brake, which tensions each thread in accordance with the corresponding speed differential. When the rate of speed of one thread or another falls below the lowest speed of a given speed range for all threads, the common shaft then takes over the operation of driving said slowest thread and continues to do so until the sensed tension of that thread decreases to the point where the sag sensor shuts down the machine.

5 Claims, 5 Drawing Figures

THREAD-TENSIONING MECHANISM FOR THE STOP MOTION MEANS OF A MULTI-NEEDLE SEWING MACHINE

BACKGROUND OF THE INVENTION

1. Field Of The Invention

This invention relates to an improved means at the beginning of the tension section for automatically establishing a normal range of tensions in that section under regular operating conditions and for promptly decreasing that tension for machine shutdown purposes under thread-breakage conditions.

2. Description Of The Prior Art

In many multi-needle machines, which are equipped with stop motion means, the individual threads coming from each supply spool are all wrapped around a common shaft or tensioning roll, located at the beginning of the thread-tensioning section. Each thread is then directed successively through (1) a tension-holding frictional device, which is located at the end of the thread-tensioning section, and (2) a take-up bar, which is located between the thread-tensioning section and the needles. The take-up bar is arranged to pull thread from each spool during the upstroke of the needles in order to have a supply of thread available for use by the needles during their ensuing downstroke. The pull of the take-up bar causes the threads to rotate the common wrap-around roll, which is lightly braked to an adjustable degree so as to resist the pull sufficiently to build up a desired degree of tension on the threads in the thread-tensioning section.

The tension of each individual thread in that section (and the speed at which it moves through that section) will vary because all such threads are not used or consumed in the sewing operation at the same rate; hence, they are not withdrawn from the thread-tensioning section at the same rate. The most rapidly consumed threads move the fastest and exert the highest pull on the common wrap-around roll. The least rapidly consumed threads move the slowest and exert the lowest pull. Since all threads, fast and slow, enter the thread-tensioning section at the same high speed, which is dictated by the fastest threads, and since they leave that section at different rates ranging from high to low, the tension of the fast threads is high while that of the slow threads is low. As a consequence, it is not uncommon for a given fast thread to be overloaded to its breakage point or for the tension on a given slow thread to drop below a desired minimum due to breakage. However, when this below-minimum tension drop occurs in an unbroken thread having a proper usage rate, it may be falsely sensed by the sag sensor as a broken thread; hence, the sag sensor responds by shutting down the machine. This false indication of breakage is highly objectionable. Where the drop is due to the usage of the slowest thread at a slow rate below the desired minimum, a shut-down is desirable. See U.S. Pat. Nos. to Hangartner 2,696,608, Kuhn 3,009,433, Vossen 3,094,855 and Jackson 3,529,560.

In our prior U.S. Pat. No. 3,698,335 granted Oct. 17, 1972, we omit the common wrap-around thread-driven shaft and substitute a thread-tensioning mechanism comprising: a power-driven take-over shaft; a group of independent wrap-around wheels, one normally driven by each thread; one-way clutch means mounting the wheels on the take-over shaft; and power means for driving the common shaft at a constant take-over speed somewhat below the lowest wheel speed corresponding to the lowest rate of thread usage. A given thread, which is wrapped around its wheel, normally functions to drive its wheel at the corresponding rate of usage. As the normal rate of usage for that given thread rises and falls: its pull or tension rises and falls; and its wheel speed rises and falls within an operative range above the shaft take-over speed. If the tension becomes too high, the thread breaks, the wheel speed drops and the take-over shaft becomes operative to drive the thread at the take-over speed. If the tension of an unbroken thread becomes too low, once again the speed of the thread-driven wheel drops and the take-over shaft becomes operative. In either case, the drop in sag renders the conventional tension sensor operative to shut down the machine.

SUMMARY OF THE INVENTION

Objects Of The Invention

The principal objects of the present invention are: to reduce thread breakage; to reduce or eliminate undesirable shut-downs; and to provide a thread-tensioning arrangement which is simple and inexpensive to construct, easy to install, effective in operation and so simply and sturdily constructed that it is not readily damaged or otherwise subject to frequent repair, replacement or other maintenance.

Statement Of The Invention

Substantially all of the foregoing objectives are readily achieved in an improved thread-tensioning mechanism comprising: independently rotatable idler wheels, one for each thread; a common take-over shaft; means independently mounting each wheel with its periphery not only frictionally engaging its thread so as to be rotated thereby but also pressing its thread against the periphery of the common take-over shaft; and power means for driving the common shaft at a take-over speed somewhat below the slowest wheel speed corresponding to the lowest rate of thread usage. In the preferred embodiment, the idler wheel presses gravitationally while its mounting means is provided with a counterweight of the adjustable micrometer screw type so that a very small accurate adjustment can be readily made in the thread-tensioning mechanism.

BRIEF DESCRIPTION OF THE DRAWINGS

The preferred embodiment of the present invention is illustrated in the accompanying drawings wherein.

BRIEF DESCRIPTION OF THE PREFERRED EMBODIMENT

Conventional Structure

Figure 1:
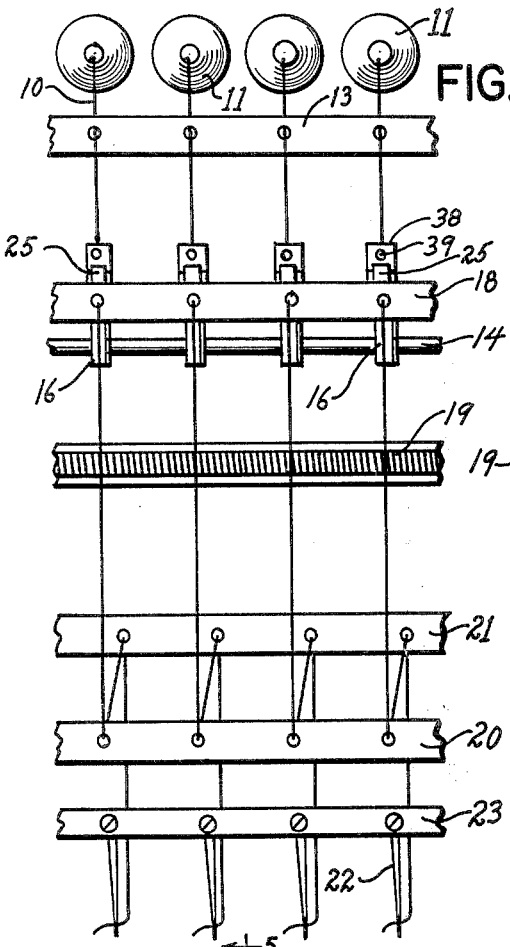
FIGS. 1–2 are fragmentary diagrammatic front and side elevational views showing, in a multi-needle sewing machine equipped with a thread-tensioning means constructed in accordance with the teachings of this invention, sewing threads extending from the supply spools through a mechanism for supporting, driving, tensioning and feeding these threads to the sewing needles.
Figure 2:
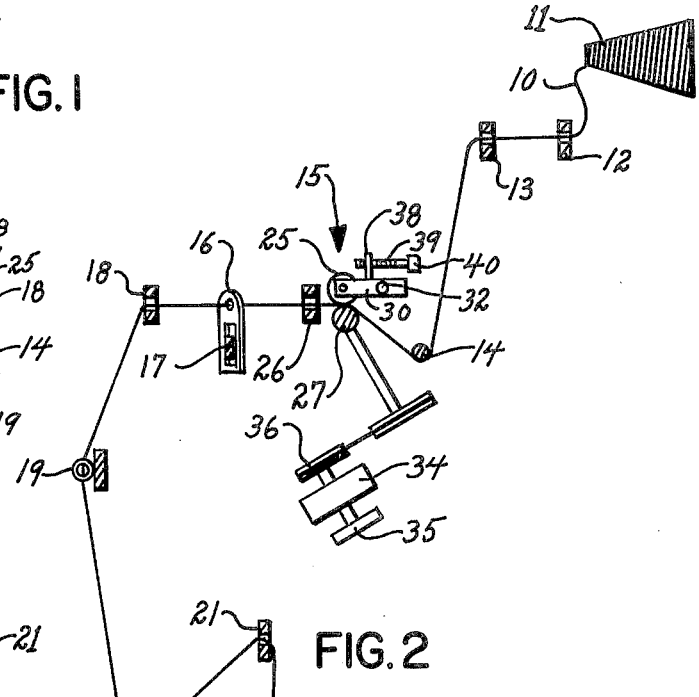
Figure 3:
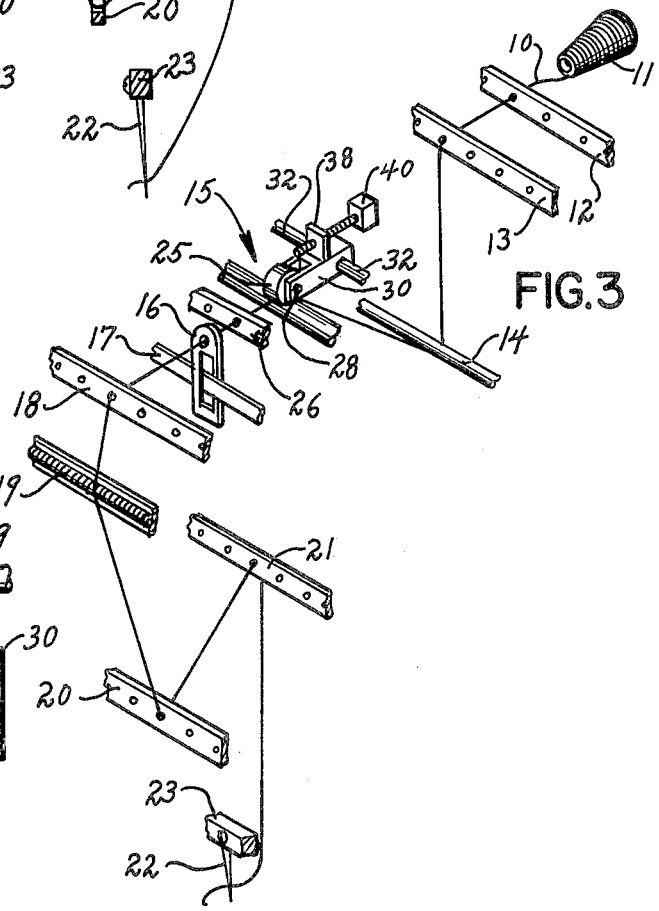
FIG. 3 is a fragmentary perspective view similar to the elevational view of FIG. 2.

In FIGS. 1–3, each individual thread 10 travels from a supply spool 11 successively through thread guides 12, 13 and 14, a thread-tensioning mechanism 15, the "drop wire" sag sensor 16 having a stationary contactor bar 17, a thread guide 18, a thread tension holding spring-wire coil 19, a guide bar 20, a thread take-up bar 21 and a needle 22 on the needle bar 23. Except for the tensioning mechanism 15, the foregoing arrangement is conventional in construction and operation; hence, further description of its structure is not believed to be necessary. It will be understood that its conventional structure may be varied in accordance with the teachings of the prior art.

Multi-needle quilting machines are conventionally used in the manufacture of a variety of products such as mattress pads, bedspreads and quilted outer and inner wear clothing material. The material fed into the machine often consists of a layer of cloth on each side of a layer of batting. This sandwich is stitched or quilted into various designs. For the sake of simplicity, we shall assume, in the present case, that a multi-needle machine is being used to sew the material together along straight, parallel stitch lines.

In such use, there are times when a needle thread breaks, causing the corresponding portion of that line of stitching to be omitted. Some machines, not equipped with stop motion means corresponding to sag sensor 16 and contactor bar 17, continue to operate until the operator of the machine observes the broken thread condition. He then stops the machine, rethreads the broken thread and reinstitutes the operation of the machine. This operator does not attempt to sew in the "line out", i.e. the line of omitted stitching, which usually is not less than a yard long and may run several yards long, depending on the alertness of the operator. Such line outs are sewn in later, usually on a single needle machine by a special line out operator, who hand-guides each line of stitching. In operations having 40 to 60 thread-breaks per machine per shift, repairing line outs is an expensive and time-consuming operation.

Many machines, conventionally provided with stop motion means, will automatically stop the machine not only when a needle thread breaks but also when a bobbin thread breaks. This reduces the length of each line out. As a consequence, a line out resulting from a broken needle thread normally measures from 3 to 9 inches long. Those resulting from a broken bobbin thread are normally twice as long, usually ranging from 6 to 18 inches in length.

The present invention does not eliminate thread breaks or line outs. For all practical purposes, it substantially eliminates machine shut-downs due to overloads on the fast threads and those occasioned by false indications of slow thread breakage.

Inventive Structure

Figure 4:
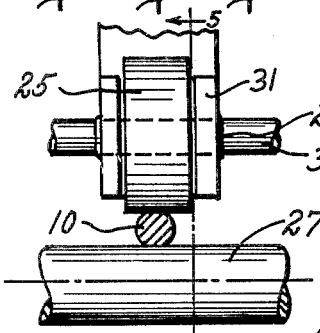
FIG. 4 is an enlarged fragmentary view showing the relationship between the idler wheel, its thread and the common shaft.
Figure 5:
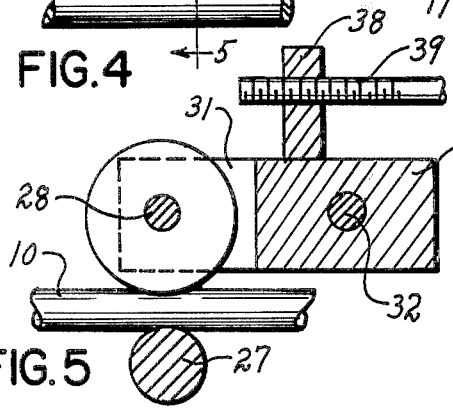
FIG. 5 is a sectional view corresponding to one taken along lines 5—5 of FIG. 4.

The preferred embodiment of our improved thread-tensioning mechanism 15, as best seen in FIGS. 3–5, comprises: A. a group of independently rotatable idler wheels 25, one for each of the needle threads 10 to be used in a given sewing operation; B. a common shaft 27 adjacent all such wheels; C. wheel-mounting means; D. common shaft drive means; and E. wheel pressure adjusting means.

The wheels 25 may be of any suitable size, shape or weight. In the preferred embodiment, the circular periphery of each wheel 25 is flat cross-sectionally; hence, a perforated guide bar 26 is located nearby and arranged to maintain the thread of its wheel substantially under the center of the periphery of its wheel. The guide bar 26 may be formed with grooves between teeth as in a comb.

The common shaft 27 may likewise be of any suitable size. It is arranged to extend across the machine directly underneath the center of the wheels 25.

The wheel-mounting means rotationally mounts each wheel 25 with its periphery not only frictionally engaging its thread so as to be rotated thereby during normal operation but also gravitationally pressing its thread against the periphery of the underlying common shaft 27. The wheel mounting means shown comprises: a wheel axle 28; and a lever 30 having axle-mounting wheel-accommodating forks 31 at one end and being pivotally mounted, through rod 32 to the frame of the machine, at a pivotal axis so located away from the axle 28 as to allow the wheel 25 to press gravitationally against its thread 10 with a force equalling or approximating the gravitational force normally desired.

The power drive means for the common shaft 27 is designed to drive that shaft at a constant speed such that its peripheral speed is somewhat below the slowest peripheral wheel speed corresponding to the lowest rate of thread usage. With this difference in lineal speeds, the slippage, between the common shaft 27 and each thread 10 pressed against it, is operative to cause the common shaft to operate as a frictional brake which holds back and thus tensions each thread in accordance with the magnitude of the slippage. The common shaft, however, becomes operative, following the breakage of a given thread in the sewing section, to drive said broken thread into the tensioning section at the lineal speed of the common speed shaft and thus "take over" the drive of that particular thread into the tension section until the sensed tension decreases to the point where the sag sensor 16 shuts down the machine.

The common shaft drive means preferably includes a readily adjustable speed change mechanism 34 (see FIG. 2) having input and output connections 35 and 36. The input connection 35 preferably is driven from the main shaft (not shown) of the multi-needle sewing machine, which is schematically indicated in FIGS. 1–3 but not otherwise shown. The output connection 36 is connected to drive the common shaft 27 at the desired take-over speed.

The adjusting means permits the gravitational pressure of each wheel 25 against its thread to be easily, quickly and accurately adjusted even in very small amounts. This adjusting means includes: an upright support 38 rigidly mounted on the top side of lever 30 between its pivot on rod 32 and the axle 28 of wheel 25. The upright support 38 is threaded to receive an adjusting screw 39. This screw is made long enough to extend from the upright support 38 along the lever 30 for a suitable distance past its pivot rod 32 where it terminates in a counterweight 40 of desired weight.

Operation Of Inventive Structure

In the present case, the variable usage of each individual thread, from its supply spool or cone 11 to its needle 22 under unbroken thread conditions, is the same as in any conventional multi-needle sewing machine. The present invention takes over only when there is a malfunction in the sewing caused by needle thread breakage or bobbin thread breakage or by an excessive loss in tension of a given unbroken thread.

Accordingly, the operation of a multi-needle sewing machine, constructed in accordance with the present invention, is identical to that of machines conventionally provided with stop motion means except that each of our wheels 25 frictionally presses its thread against the slower moving periphery of the common shaft setting up a slippage therebetween together with a frictional rubbing pressure which tends to hold back or restrain the movement of the thread. As a result, a tension is placed and maintained on the thread-tensioning section of each individual thread. This tension varies in direct accordance with the pressurized slippage and, for a given pressure, with the thread speed or rate at which that thread is used or consumed. For a given sewing operation, we may assume that the tension on each thread individually, and of all threads collectively, will normally be within an operative range having more or less known minimum and maximum values corresponding to the amount of thread required by the smallest and largest stitches. Consequently, the speed change mechanism 34 is adjusted to drive the common shaft 27 at a constant rotational speed slightly below the slowest usage rate of said operative range.

It will be understood that each needle thread 10 preferably extends between the peripheries of its wheel 25 and of the common shaft 27 and in tangential relationship to both and that it rotates its wheel 25 independently of the rotation of all other wheels at a rate determined by its own variable usage rate. The tension and the load on the fastest intact needle thread will be the product of its own fast usage rate alone. This eliminates thread-breakage overloads which occur in the prior art on the fastest thread of a group when that thread has to drive a common wrap-up roll for all members of the group.

Similarly, the low tension on the slowest intact needle thread will be the product of its own slow usage rate. This eliminates the development, on the slowest intact thread in a group, of a tension which, as in the prior art, is the product of its fast entry into the tensioning section, due to the fast usage rate of the fastest thread, and its slow exit therefrom, due to its own slow usage rate; hence, it correspondingly eliminates the loss of tension on the slower unbroken threads which give rise to false indications of thread breakage.

In the present case, if the speed of the slowest intact thread 10 of the group decreases to the point where its tension, in its tensioning section, drops below the desired range minimum, such tension drop will necessarily be due to the below-minimum slippage and rate of usage of that particular thread. The below-minimum tension in this case results in sag sensor's operation of the stop motion means which shuts down the sewing machine. This shut-down is desirable because the quality of sewing is always poor where the machine is not using enough thread.

Obviously, if any needle thread breaks, there will be a rapid loss of tension in its intermediate tensioned section. Likewise, if the bobbin thread for any needle thread breaks, there will be a rapid loss of tension in the intermediate tension section of its needle thread but, in this case, the speed of such loss may be cut in half. In each case, the drop wire of sag sensor 16 is quickly lowered into contact with the stationary contactor bar 17 causing the stop motion means to shut down the operation of the machine. The lowered position of the drop wire enables the operator to locate the break quickly and thus minimize the loss of time involved in rethreading the broken thread and reinstituting the operation of the machine.

It will be understood that a given range of usage embracing all threads in the group results in or corresponds to a given range of thread speeds embracing all threads in the group. Light springs and weak magnetic attractions are less preferable means, which might be used to compress a given thread between its idler wheel and said common shaft.

It will be appreciated that the idler wheel mounting means is continuously operative to cause the wheel periphery to exert a constant pressing force against the variable speed thread and constant speed common shaft 27 and that the wheel mounting means is independent of and out of operative engagement with the thread after it leaves said idler wheel so that said constant idler wheel pressure is not affected by variations in any operating speed or tension condition of the tensioned thread.

Having described my invention, I claim:

1. An improved thread-tensioning mechanism for the stop motion means of a multi-needle sewing machine of the type having a group of needle threads wherein each needle thread of the group, in extending from its supply spool to its needle, normally travels through a thread-tensioning section at a speed and tension proportional to its individual rate of variable usage within a given range of usages, embracing all threads in said group, and wherein the tension section of each thread normally carries a sag-sensor for operating the stop motion means when the thread usage falls below said given range, comprising:

A. a common take-over shaft extending across the machine at the beginning of the thread-tensioning section;

B. means for rotating said shaft at a substantially constant speed such that the lineal speed of its periphery is slightly below the slowest normal lineal thread speed created in said given range by the slowest normal rate of thread usage;

C. an idler wheel at the beginning of the tensioning section of each thread; and D. means mounting each idler wheel with its periphery not only in continuous frictional engagement with its moving thread so as to be continuously rotated thereby during normal operation but also continuously pressing said thread with a constant force into frictional engagement with the periphery of said common shaft so as to cause that shaft normally to operate as a frictional brake tensioning each thread in accordance with the corresponding wheel-shaft speed differential, which varies with the variable rate said thread is used up in a sewing operation, 1. said wheel mounting means being independent of and out of operative engagement with the tensioned thread so that said constant idler wheel pressure is not affected by variations in any operating speed or tension condition of the tensioned thread.

2. The mechanism of claim 1 wherein:

A. said idler wheel is mounted to press gravitationally against its thread.

3. The mechanism of claim 1 wherein:

A. the mounting means includes a lever carrying the idler wheel at one point and pivotally mounted at a spaced point to direct the wheel gravitationally downward into contact with its thread.

4. The mechanism of claim 1 including:

A. means for adjustably counterweighting said lever for thread pressure adjusting purposes.

5. An improved multi-needle machine comprising:

A. a multi-needle machine of the type having a group of needle threads wherein each needle thread of the group, in extending from its supply spool to its needle, normally travels through a thread-tensioning section at a speed and tension proportional to its individual rate of variable usage within a given range of usages, embracing all threads in the group, and wherein the tension section of each thread normally carries a sag-sensor for operating the stop motion means when the thread usage falls below said given range;

B. a common take-over shaft extending across the machine at the beginning of the thread-tensioning section;

C. means for rotating said shaft at a substantially constant speed such that the lineal speed of its periphery is slightly below the slowest normal lineal thread speed created in said given range by the slowest normal rate of thread usage;

D. an idler wheel at the beginning of the tensioning section of each thread; and E. means mounting each idler wheel with its periphery not only in continuous frictional engagement with its moving thread so as to be rotated thereby during normal operation but also continuously pressing said thread with a constant force into frictional engagement with the periphery of said common shaft so as to cause that shaft normally to operate as a frictional brake tensioning each thread in accordance with the corresponding wheel-shaft speed differential, which varies with the variable rate said thread is used up in a sewing operation, 1. said wheel mounting means being independent of and out of operative engagement with the tensioned thread so that said constant idler wheel pressure is not affected by variations in any operating speed or tension condition of the tensioned thread.

* * * * *